US005938965A

United States Patent [19]

Madeira

[11] Patent Number: 5,938,965

[45] Date of Patent: Aug. 17, 1999

[54] INDUCTOR FOR REMOVING PAINT FROM WIRE HOOKS

[75] Inventor: Robert John Madeira, Hampton Cove, Ala.

[73] Assignee: Tocco, Inc., Boaz, Ala.

[21] Appl. No.: 09/053,223

[22] Filed: Apr. 1, 1998

[51] Int. Cl.[6] ..... H05B 6/10

[52] U.S. Cl. ..... 219/635

[58] Field of Search ..... 219/635, 653, 219/670, 672; 110/236; 336/225, 179, 55, 227

[56] References Cited

U.S. PATENT DOCUMENTS

| | | | |
|---|---|---|---|
| 2,052,010 | 8/1936 | Bailey et al. | 219/653 |
| 2,342,532 | 2/1944 | Doelker et al. | 219/672 |
| 2,599,229 | 6/1952 | Bukaty et al. | 219/653 |
| 3,005,893 | 10/1961 | Dixon et al. | 219/653 |
| 3,031,555 | 4/1962 | Ross et al. | 219/672 |
| 3,725,629 | 4/1973 | Vickers et al. | 219/670 |
| 5,025,122 | 6/1991 | Howell et al. | 219/670 |
| 5,617,800 | 4/1997 | Moreschi . | |
| 5,630,958 | 5/1997 | Stewart et al. | 219/670 |

*Primary Examiner*—Teresa Walberg
*Assistant Examiner*—Jeffrey Pwu
*Attorney, Agent, or Firm*—Vickers, Daniels & Young

[57] ABSTRACT

An inductor is provided for removing paint from a workpiece traveling along a longitudinal path and having a vertical stem portion intersecting the path and a hook portion having a juncture with the stem portion and extending laterally to one side of the path. The inductor has front and rear ends and the workpiece travels along the path in the direction from the front end to the rear end. The inductor comprises a coil having first and second ends for connection to a power source and a plurality of elongated conductor segments connected in series between the ends and located on opposite sides of and parallel to the path and inductively coupled with the hook and stem portions of the workpiece for heating the latter to remove the paint therefrom.

23 Claims, 5 Drawing Sheets

INDUCTOR FOR REMOVING PAINT FROM WIRE HOOKS

BACKGROUND OF THE INVENTION

The present invention relates to the art of induction heating, and more particularly to an inductor for uniformly heating asymmetrically shaped workpieces traveling along a selected path.

This invention is particularly applicable to removing paint from hanger hooks moving along a path and having J-shaped lower ends used to hang parts in spray paint production lines, and it will be described with particular reference thereto; however, it will be appreciated that the invention has much broader applications and can be used for inductively heating a variety of asymmetrical workpieces traveling along a predetermined path.

In electrostatic spray painting operations, the part to be painted must be electrically grounded to the sprayer machinery in order for the paint to be applied uniformly and efficiently. Spray painting is sometimes performed with the painted parts hanging from an overhead conveyor line. The parts are typically suspended from the conveyor using hangers with J-shaped hooks at the bottom. These hangers may also include complimentary J-shaped hooks at the top, being thereby reversible in use. Sprayed paint is normally deposited on the part as well as on the lower hook portion of the hanger. To ensure a proper electrical connection between the painted parts and the spray paint machinery, these hanger hooks must be cleaned prior to reuse with a new part. Induction heating is one method of heating the surface of these hangers in order to remove the deposited paint. Induction heating fractures the bond interface between the paint film and the metal hook such that the paint falls off or can be easily brushed off mechanically. Induction heating also minimizes the energy used and reduces excessive incineration of the paint film, thereby reducing the amount of noxious fumes generated. To remove all the deposited paint, it is desirable that the heat be applied uniformly to all the surfaces upon which paint is deposited. It is well known in the art that uniform inductive heating of the exterior surface of a symmetrical workpiece can be accomplished using inductor coils which completely encircle the workpiece, thereby providing uniform inductive coupling to the entire workpiece surface. An alternative to complete workpiece encirclement, also well known in the art, is the use of flux concentrator materials located with respect to the inductor and the workpiece so as to optimize the coupling of magnetic flux along the workpiece surface. Depending on workpiece geometry, complete workpiece encirclement may be difficult or impossible. Flux concentrators are costly and their performance degrades over time.

Removing paint from hanger hooks in a spray painting operation using induction heating equipment presents problems, one of which is uniform inductive coupling of the asymmetrical portions of the hook shaped hanger workpiece. Locating the induction heating coil segments so as to provide uniform coupling while allowing continuous movement of the workpiece along a path below an overhead conveyor is difficult in this situation.

In one effort to overcome these problems, a prior hanger hook induction heating system disclosed in U.S. Pat. No. 5,617,800 to Moreschi et al. utilizes a four-sided induction heating apparatus including one side directly underneath the workpiece path. This arrangement, however, suffers from the collection of removed paint particles on the lower side of the induction heating apparatus. This accumulation of paint particles can result in non-uniform heating of the hanger workpieces, lower system efficiency, and increased maintenance costs in that the accumulated paint must be removed periodically to avoid non-uniform heating and reduced system efficiency. Consequently, there remains a need for an inductor which provides consistent uniform heating to asymmetrical workpieces suspended from an overhead conveyor apparatus, without the added expense of flux concentrator devices.

Another difficulty in achieving uniform surface heating and the resultant uniformity in paint removal results from hanger workpieces passing the induction heating equipment laterally offset from the normal workpiece path below the conveyor line, whether statically offset or laterally swaying from side to side. In this situation, one side of the hanger workpiece may get too much heat while the other side gets too little. In addition, electrical power supply problems can result if a workpiece contacts the inductor, particularly in electrostatic painting operations where the workpiece is electrically grounded through the conveyor apparatus. The Moreschi system employs lateral stabilizing belts in an attempt to avoid this problem. Use of stabilizing belts or devices, however, results in increased system cost and increased maintenance costs. Accordingly, there remains a need for an efficient, low cost induction heating inductor with an open bottom and which uniformly removes paint from asymmetrically shaped hanger hooks without the need for lateral stabilization belts or devices.

SUMMARY OF THE INVENTION

The present invention relates to an improved induction heating inductor with a unique coil configuration which meets the aforementioned need for uniformly heating asymmetrical workpieces moving past the inductor along a predetermined path and which avoids or minimizes the prior art disadvantages including those discussed above. In particular, the present invention uniformly heats asymmetrical workpieces traveling along a path, without the added expense of flux concentrator devices, with an open bottom to minimize maintenance costs and improve efficiency, and without lateral stabilization devices.

In accordance with the present invention, there is provided an inductor comprising a coil having a plurality of coil segments located parallel to each other and to the workpiece path in a configuration structurally related to the asymmetrical shape of the workpiece, wherein no coil segments extending along the path are located directly below the workpiece path. The coil configuration further provides adequate lateral spatial clearance to accomplish uniform induction heating despite lateral workpiece sway or positional offset. In particular, the coil configuration provides uniform electromagnetic coupling of energy to the asymmetrical J-shaped portion of the workpiece without need for flux concentrator devices or lateral positioning or stabilizing devices, thereby allowing uniform induction heating of and paint removal from the workpiece through induced electrical current and easy adaptation of existing conveyorized systems without expensive modifications.

A primary object of the present invention is the provision of an induction heating inductor having a unique coil configuration structurally related to an asymmetrically shaped workpiece moving along a path, whereby the asymmetrical portion of the workpiece is uniformly heated.

Another object of the present invention is the provision of an induction heating inductor of the type described above having a unique coil configuration structurally related to a J-shaped workpiece, whereby the asymmetrical J-shaped portion of the workpiece is uniformly heated, thereby resulting in economical, efficient and uniform removal of paint from the workpiece.

Another object of the present invention is the provision of an induction heating inductor of the type described above having a unique coil segment configuration structurally related to the asymmetrical J-shape of the workpiece and to the workpiece movement path, wherein the coil segment configuration provides an open bottom through which paint particles removed from the workpiece fall, thereby avoiding or minimizing accumulation of removed paint particles on the inductor segments.

A further object of the present invention is the provision of an induction heating inductor of the type described above wherein uniform coupling of electromagnetic energy to the asymmetrical portion of the workpiece is provided without the use of external flux concentrator devices, thereby resulting in uniform, cost effective, energy efficient removal of paint from the workpiece.

Another object of the present invention is the provision of an induction heating inductor of the type described above wherein uniform heating of the asymmetrical portion of the workpiece is achieved despite lateral swaying or misalignment of the workpiece, whereby uniform, cost effective paint removal is achieved without the need for lateral stabilizing devices or expensive modification of existing conveyorized systems.

BRIEF DESCRIPTION OF THE DRAWINGS

The foregoing and other objects and advantages will become apparent from the following description of a preferred embodiment of the present invention illustrated in the accompanying drawings in which.

DESCRIPTION OF A PREFERRED EMBODIMENT

Figure 1:
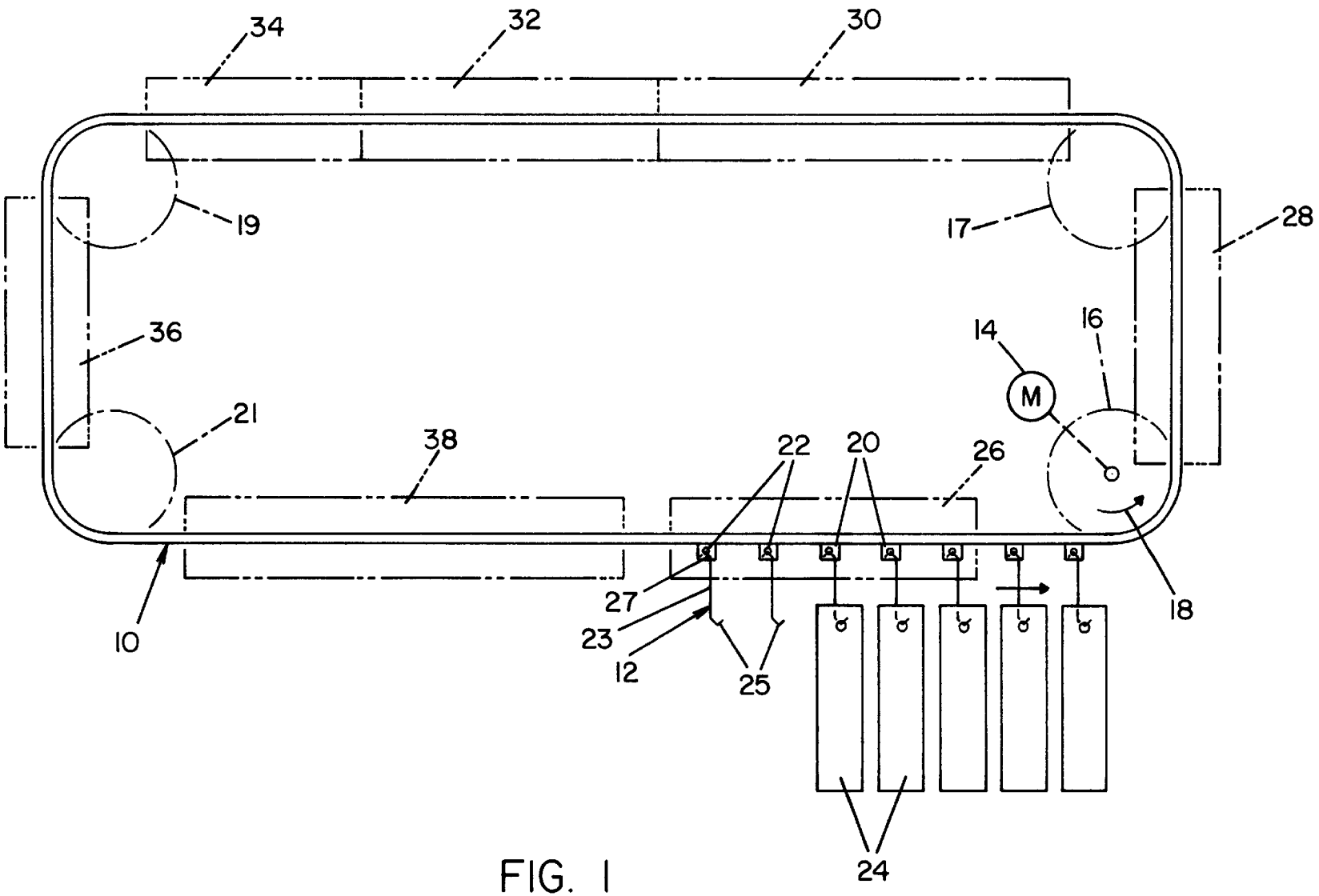
FIG. 1 is a schematic illustration showing a spray painting production line.
Figure 2:
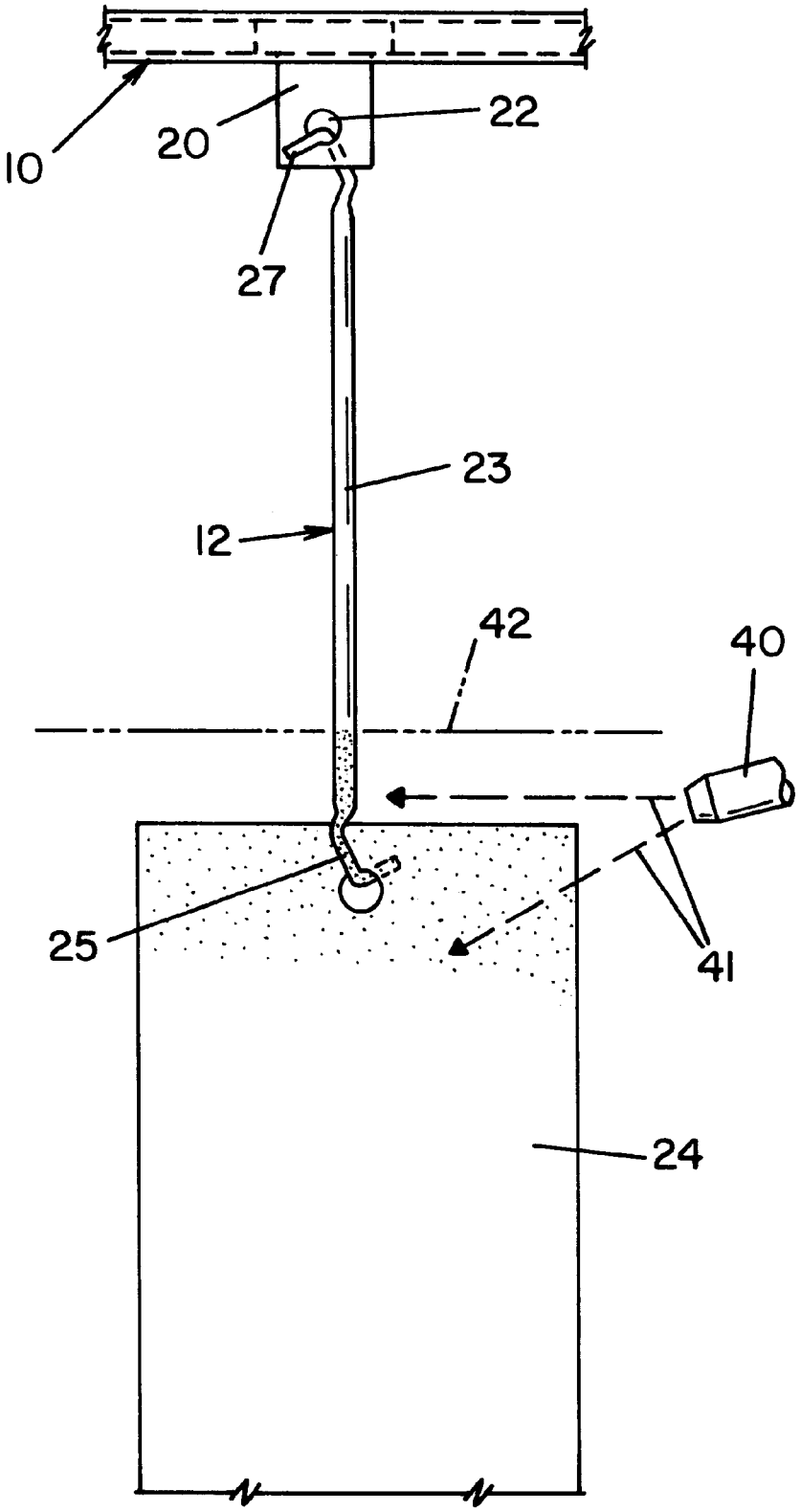
FIG. 2 is an enlarged elevation view showing a workpiece in a spraying area of the production line.

Referring now to the drawings wherein the showings are for the purpose of illustrating a preferred embodiment of the invention only and not for the purpose of limiting the same, FIG. 1 schematically illustrates a spray painting production line, partially in plan view for illustrating the various work areas therealong, and partially in elevation view for illustrating details of the conveyor system and the suspension of production parts therefrom. This spray painting production line includes a conveyor belt 10 for moving workpiece hanger hooks 12 along the path of belt 10 which is driven by a motor 14 and a belt drive member 16. The belt path is determined by drive member 16 and idler members 17, 19 and 21 which are arranged sequentially with respect to the conveyor drive direction indicated by arrow 18. The hangers 12 are suspended from conveyor 10 by conveyor brackets 20 having holes 22. Hangers 12 are constructed of wire preferably 0.125 inches in diameter and have a vertical stem portion 23 intersecting the travel path of the hangers 12, a J-shaped lower hook portion 25 laterally offset to one side of the path, and an upper hook portion 27 laterally offset to the other side of the path to engage hole 20. Hangers 12 are used to convey articles 24 along a work path through various sequential work areas 26, 28, 30, 32, 34, 36, and 38 as described below and shown schematically in FIG. 1. Initially, the articles 24 are loaded onto the production line in loading area 26 by suspending the articles 24 from the lower hook portions 25 of hangers 12. The conveyor 10 then moves the loaded articles 24 to a pretreating area 28, wherein the articles are prepared to receive paint. Articles 24 then move through a painting area 30 wherein paint is applied to articles 24 as well as to a portion of stem portion 23 and to lower hook portion 25 of the hangers 12 as shown in FIG. 2 and discussed hereinafter. Once painted, the articles 24 pass through a drying area 32 wherein the applied paint is dried, typically through application of heat. Next, the suspended articles 24 enter a cooling area 34 where the articles 24 are cooled to allow subsequent removal from the hangers 12 in an unloading area 36. The empty hangers 12 are then moved to a cleaning area 38 in which the residual paint is removed from the stem portion 23 and the lower hook portion 25 of hangers 12 using the induction heating apparatus according to the present invention as set forth hereinafter. With the hangers 12 thus cleaned, the process is then repeated as the hangers 12 are again conveyed into loading area 26.

Referring now to FIG. 2, which shows a typical spray painting area, the article 24 is conveyed past paint spray nozzle 40 which applies paint in direction 41 to article 24, stem portion 23 and lower hook portion 25 of the workpiece hanger hook 12 below spray line 42. Once the painted article 24 is removed in unloading area 36, the hanger 12 is left suspended from conveyor bracket 20 with sprayed paint remaining on lower hook portion 25 and stem portion 23 below spray line 42. This remaining paint must be removed prior to loading a new article 24 onto the hanger 12 in loading area 26 to allow proper painting of the new article 24.

Figure 3:
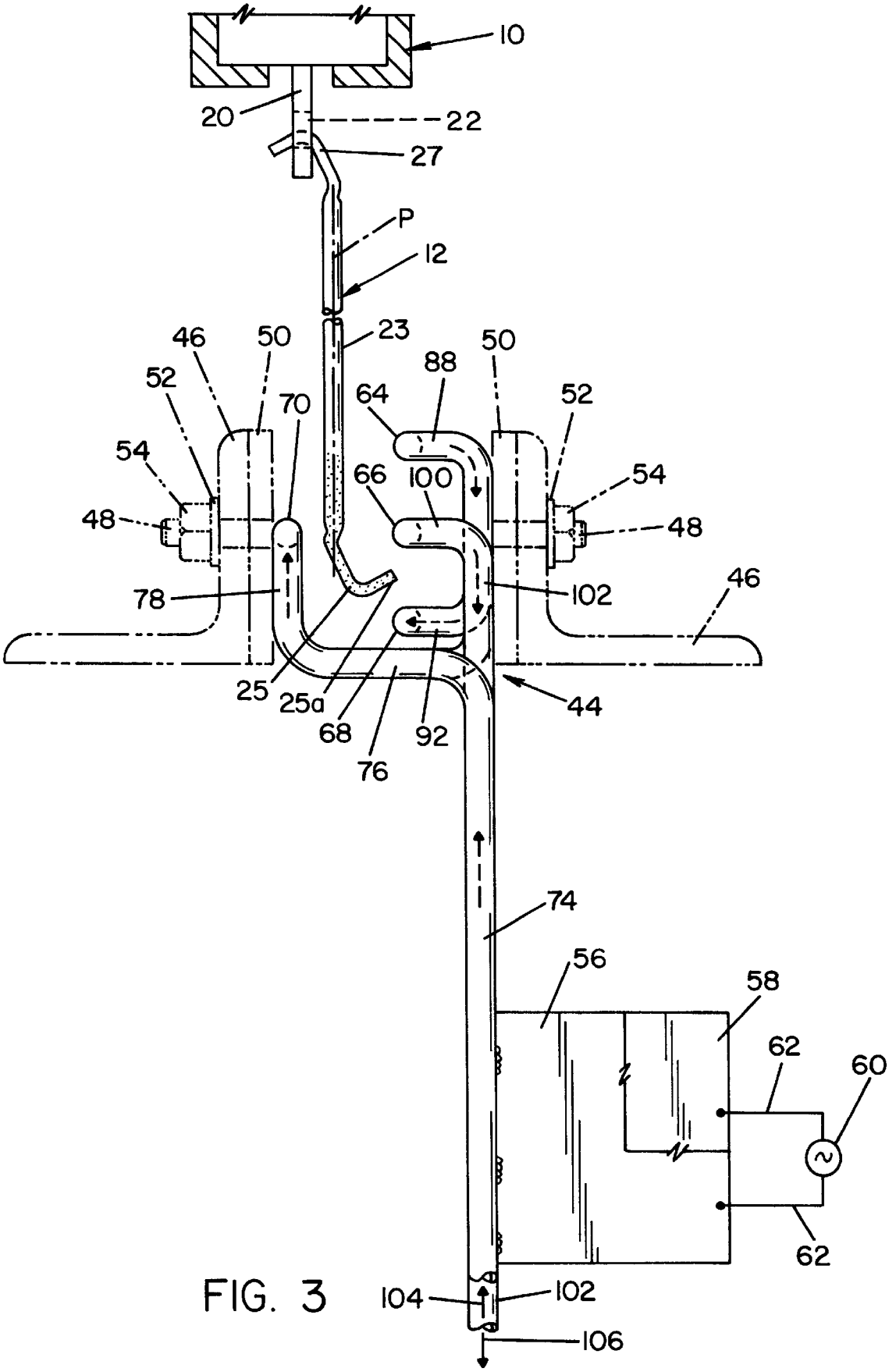
FIG. 3 is an end elevation view of a preferred embodiment of an inductor according to the invention.
Figure 4:
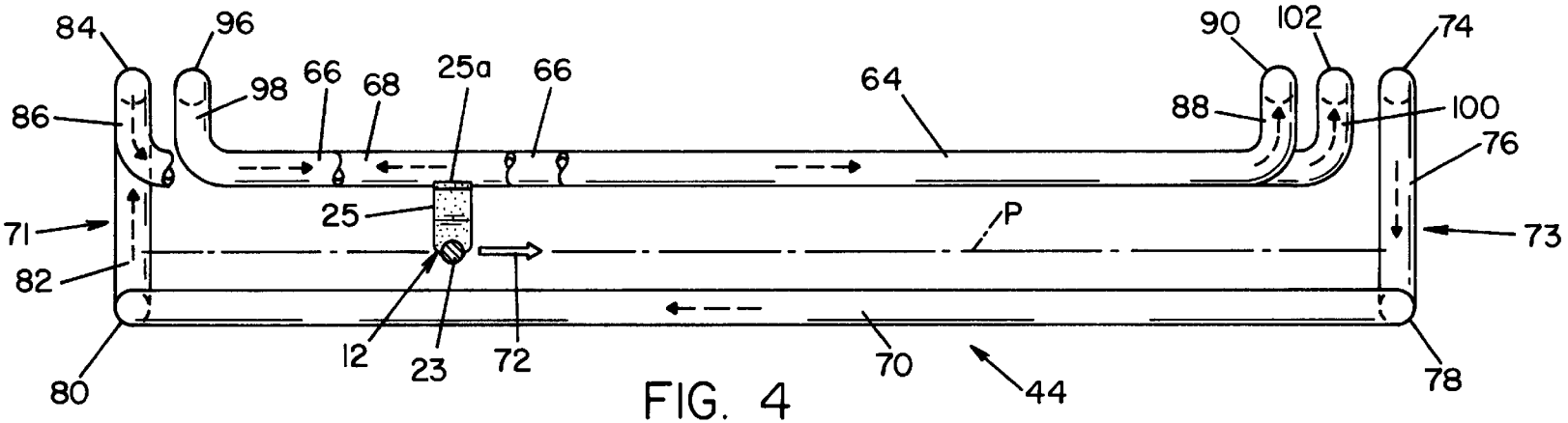
FIG. 4 is a plan view of the inductor.
Figure 5:
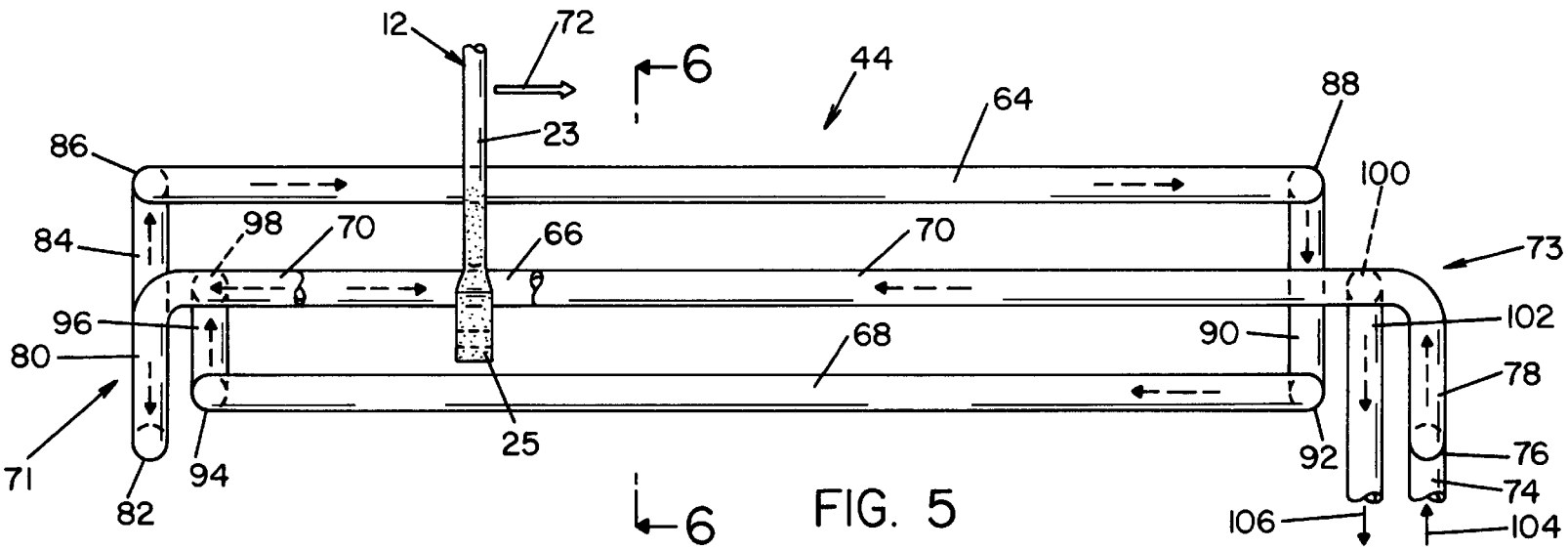
FIG. 5 is a side elevation view of the inductor.
Figure 6:
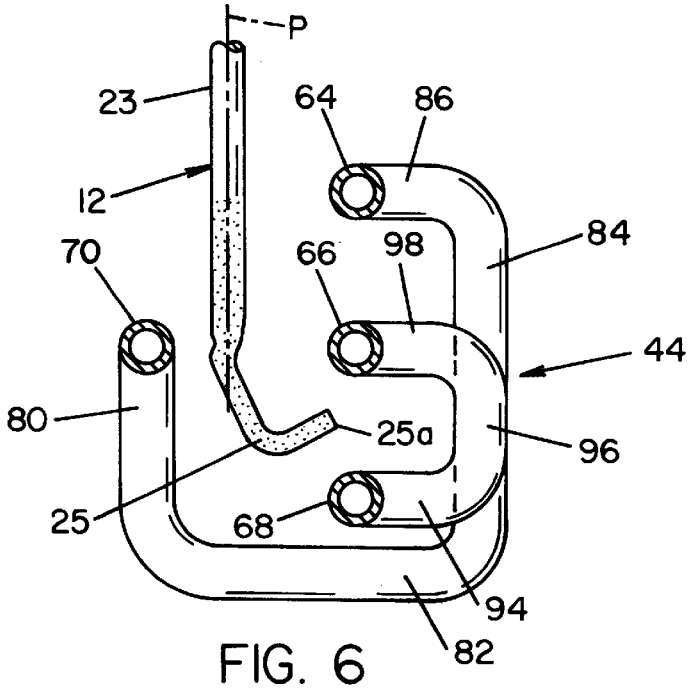
FIG. 6 is a cross-sectional elevation view of the inductor taken along line 6—6 in FIG. 5; and, FIG. 7 is a perspective view of the inductor.
Figure 7:
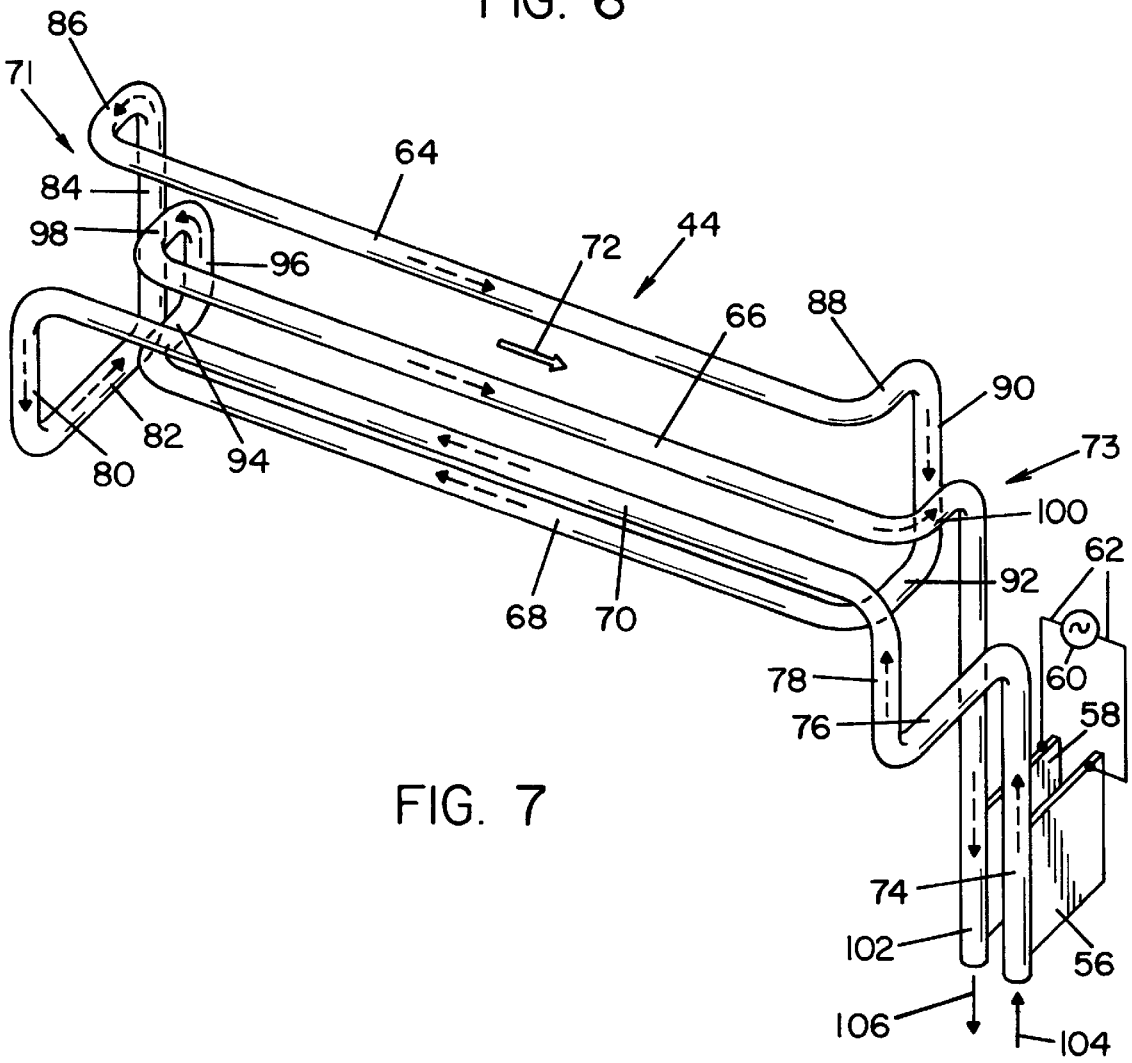

FIGS. 3–7 illustrate an inductor 44 in accordance with the present invention and illustrate a partially painted hanger 12 traveling along a hanger path P beneath conveyor 10 past inductor 44, while suspended from conveyor bracket 20 through conveyor bracket hole 22. Hanger path P is defined by a vertical plane extending between the opposite longitudinal ends of inductor 44 and bisecting stem portion 23 of hanger 12. As shown in FIG. 3, inductor 44 is attached to mounting brackets 46 by threaded fasteners 48 which pass through electrical insulators 50, mounting brackets 46 and washers 52, before engaging the inner threads of nuts 54. As nuts 54 are tightened, the threaded fasteners 48 draw inductor 44 tight against insulators 50, thus securing the inductor apparatus 44 to the mounting brackets 46 while maintaining electrical isolation therebetween. The inductor includes a coil described in detail hereinafter, having a first coil end busbar 56 and a second coil end busbar 58 for electrical connection to a power source 60 through cables 62, as shown in FIGS. 3 and 7. The coil consists of first, second, third, and fourth elongated conductor segments 64, 66, 68 and 70, respectively, located generally parallel to the longitudinal hanger travel path P. Segments 64, 66, 68 and 70 are each much longer than the diameter of the wire of hanger workpieces 12, thereby providing uniform heating to and thus universal paint removal from each individual hanger 12 regardless of the number of hangers 12 passing the inductor 44 in a given period of time. The hangers 12 move along path P from the inductor front end 71 toward the inductor rear end 73 in the direction indicated by arrow 72 as shown in FIGS. 4, 5 and 7.

Referring now to FIG. 7, the elongated conductor segments 64, 66, 68 and 70 are connected together in serial fashion by various connector segments as described hereinafter, to form a circuitous electrically conductive path between first busbar 56 and second busbar 58. Each connector segment is located in a corresponding plane generally lateral to the longitudinal workpiece travel path P. More particularly busbar 56 is connected by a first connector segment comprised of conductor portions 74, 76 and 78 to the rear end of fourth conductor segment 70. Continuing on, the front end of fourth segment 70 is connected by a second connector segment comprised of conductor portions 80, 82, 84 and 86 to the front end of first conductor segment 64. The rear end of the first segment 64 is connected by a third connector segment comprised of conductor portions 88, 90 and 92 to the rear end of the third conductor segment 68. The front end of third segment 68 is then connected to the front end of second segment 66 by a fourth connector segment comprised of conductor portions 94, 96 and 98. Finally, the rear end of second conductor segment 66 is connected by a fifth connector segment comprised of conductor portions 100 and 102 to second busbar 58 to complete the circuitous coil electrical path. As shown in FIGS. 6 and 7, coil 44 is made of hollow tubing to allow the circulation of cooling fluid through the coil in a direction generally following the electrical path just described. The cooling fluid is circulated through inlet and outlet fluid transfer ports 104 and 106, respectively, as shown in FIG. 7.

Referring now to FIGS. 4, 5 and 6, the first, second and third conductor segments 64, 66 and 68, respectively, are located in a longitudinal first vertical plane generally parallel to hanger travel path P and spaced from the path so as to be inductively coupled with workpiece 12. First segment 64 is directly above second segment 66, which in turn is directly above third segment 68, and the vertical spacing between the first and second segments 64 and 66, as well as between the second and third segments 66 and 68, is between 0.30 and 0.75 inches, preferably 0.50 inches. This first vertical plane is laterally offset approximately 0.50 inches to the side of the longitudinal workpiece path to which the lower hook portion 25 is laterally offset. The fourth segment 70 is laterally offset toward the other side of the path from the longitudinal first vertical plane between 0.75 and 1.00 inches to the other side of the workpiece path so as to be inductively coupled with the workpiece 12, and preferably, the offset is approximately 0.75 inches. The conductor segment location and orientation provides an open bottom, and paint particles falling off the outer surface of the hangers 12 will fall past each of the four segments 64, 66, 68 and 70 without accumulating thereon. The fourth conductor segment 70 and the second segment 66 are located in a horizontal plane which intersects the juncture of vertical stem portion 23 and lower hook portion 25 of the hanger 12. Finally, second segment 66 and third segment 68 are respectively located an equal distance above and below and adjacent the outermost extremity 25*a* of lower hook portion 25 of the hangers 12 as they move along the longitudinal path P as shown in FIGS. 5 and 6. By this asymmetrical configuration of coil conductor segments 64, 66, 68 and 70, vertical stem portion 23 of the hanger 12 is inductively coupled, primarily, with first segment 64 and fourth segment 70 while the lower hook portion 25 of hanger 12 is inductively coupled, primarily, with second and third segments 66 and 68, respectively. No inductive coupling is provided between portions 76, 78, 80, 82, 84, 96 or 102 and hanger 12. This coil configuration provides for inductor 44 to have uniform coupling with, and consequently enables uniform paint removal from, the asymmetrical J-shaped hangers 12. While the embodiment described is preferred in order to obtain optimal paint removal, paint removal from hangers 12 can be achieved with a coil configuration which would include, for example, only third and fourth conductor segments 68 and 70, or only second and third conductor segments 66 and 70, respectively.

As many possible embodiments of the present invention may be made, and as many possible changes may be made in the embodiment set forth herein, it is to be distinctly understood that the foregoing descriptive matter is to be interpreted merely as an illustration of the invention and not as a limitation.

Having thus described the invention, it is claimed:

1. An inductor for heating at least one workpiece traveling along a longitudinal path, said workpiece having a vertical stem portion intersecting said path and a hook portion having a juncture with said stem portion and extending laterally and upwardly to one side of said path, said hook portion including said juncture having paint thereon, said inductor having a front end and a rear end, said workpiece traveling along said path in the direction from said front end to said rear end, said inductor comprising a coil having first and second ends for connection to a power source, said coil comprising a plurality of elongated conductor segments connected in series between said ends of said coil and located parallel to said path for inductively heating just said hook portion and the juncture thereof with said stem portion for removing paint therefrom, said plurality of conductor segments including at least one segment located on said one side of said path and inductively coupled with said hook portion of said workpiece for heating said hook portion to remove paint therefrom, and at least one segment located on the other side of said path and inductively coupled with said workpiece at said juncture for heating said juncture to remove paint therefrom.

2. The inductor as defined in claim 1, wherein said coil is comprised of just four of said elongated conductor segments.

3. The inductor as defined in claim 2, wherein said at least one segment located on said one side and said at least one segment located on said other side are asymmetric with respect to said path.

4. The inductor as defined in claim 3, wherein three of said conductor segments are located on said one side of said path in a vertical plane laterally outwardly of said laterally extended hook portion of said workpiece.

5. The inductor as defined in claim 4, wherein said three conductor segments are equally spaced apart by a vertical distance, a first segment of said three is above a second segment of said three, and said second segment is above a third segment of said three.

6. The inductor as defined in claim 5, wherein said second segment is located in a horizontal plane intersecting said juncture of said vertical stem portion and said hook portion of said workpiece, and the fourth of said segments is located in said horizontal plane and on said other side of said path and is spaced from said second segment by a horizontal distance.

7. The inductor as defined in claim 6, wherein each said first, second, third and fourth conductor segment has a front end at said front end of said inductor and a rear end at said rear end of said inductor, said first end of said coil being connected to said rear end of said fourth segment by a first connector segment, the front ends of said first and fourth conductor segments being connected by a second connector segment, the rear ends of said first and third conductor segments being connected by a third connector segment, the front ends of said second and third conductor segments being connected by a fourth connector segment, and the rear end of said second conductor segment being connected to said second end of said coil by a fifth connector segment, each said connector segment lying in a corresponding plane extending laterally of said path.

8. The inductor as defined in claim 6, wherein said stem has a thickness of approximately 0.125 inch and said horizontal distance is between 0.50 and 1.00 inches.

9. The inductor as defined in claim 8, wherein said vertical distance is between 0.30 and 0.75 inches.

10. The inductor as defined in claim 9, wherein said horizontal distance is approximately 0.75 inches.

11. The inductor as defined in claim 10, wherein said vertical distance is approximately 0.50 inches.

12. The inductor as defined in claim 11, wherein each said first, second, third and fourth conductor segment has a front end at said front end of said inductor and a rear end at said rear end of said inductor, said first end of said coil being connected to said rear end of said fourth segment by a first connector segment, the front ends of said first and fourth conductor segments being connected by a second connector segment, the rear ends of said first and third conductor segments being connected by a third connector segment, the front ends of said second and third conductor segments being connected by a fourth connector segment, and the rear end of said second conductor segment being connected to said second end of said coil by a fifth connector segment, each said connector segment lying in a corresponding plane extending laterally of said path.

13. The inductor as defined in claim 12, wherein each of said connector segments is in inductively decoupled relationship with said workpiece.

14. The inductor as defined in claim 13, wherein each said corresponding plane is perpendicular to said path.

15. The inductor as defined in claim 1, wherein said conductor segments are asymmetrical with respect to said path.

16. The inductor as defined in claim 1, wherein three of said conductor segments are located on the one side of said path in a vertical plane laterally spaced from said path beyond said laterally extended hook portion of said workpiece.

17. The inductor as defined in claim 16, wherein said plurality includes at least four said conductor segments, three of which are equally spaced apart by a vertical distance, a first segment of said three is above a second segment of said three, and said second segment is above a third segment of said three.

18. The inductor as defined in claim 17, wherein said second segment is located in a horizontal plane intersecting said juncture of said vertical stem portion and said hook portion of said workpiece, and the fourth of said segments is located in said horizontal plane and on said other side of said path and is spaced from said second segment by a horizontal distance.

19. The inductor as defined in claim 18, wherein each said first, second, third and fourth conductor segment has a front end at said front end of said inductor and a rear end at said rear end of said inductor, said first end of said coil being connected to said rear end of said fourth segment by a first connector segment, the front ends of said first and fourth conductor segments being connected by a second connector segment, the rear ends of said first and third conductor segments being connected by a third connector segment, the front ends of said second and third conductor segments being connected by a fourth connector segment and the rear end of said second conductor segment being connected to said second end of said coil by a fifth connector segment, each said connector segment lying in a corresponding plane extending laterally of said path.

20. An inductor for heating at least one workpiece traveling along a longitudinal path, said workpiece having a vertical stem portion intersecting said path and a hook portion having a juncture with said stem portion and extending laterally to one side of said path, said inductor having a front end and a rear end, said workpiece traveling along said path in the direction from said front end to said rear end, said inductor comprising a coil having first and second ends for connection to a power source, said coil comprising just four coil sections extending between said front and rear ends and asymmetrical with respect to said path, and each said section being inductively coupled with one of said stem and hook portions of said workpiece.

21. The inductor as defined in claim 20, wherein said coil comprises first, second, and third conductor segments located on said one side of said path in a vertical plane laterally spaced from said path beyond said laterally extended hook portion of said workpiece, said first, second, and third segments being equally spaced apart in said plane, and said coil further comprising a fourth conductor segment located on the other side of said path.

22. The inductor as defined in claim 21, wherein said second and fourth conductor segments are located in a horizontal plane intersecting said juncture of said hook portion and said stem portion.

23. The inductor as defined in claim 22, wherein each conductor segment has a front end near said front end of said inductor and a rear end near said rear end of said inductor, said first coil end being connected to the rear end of said fourth segment by a first connector segment, the front ends of said fourth and first segments being connected by a second connector segment, the rear ends of said first and third segments being connected by a third connector segment, the front ends of said second and third segments being connected by a fourth connector segment, the rear end of said second segment being connected to said second coil end by a fifth connector segment, said stem portion being inductively coupled with said first and fourth conductor segments, said hook portion being inductively coupled with said second and third conductor segments, and said first, second, third, fourth and fifth connector segments being in inductively decoupled relationship with said workpiece.

* * * * *